US006651744B1

(12) United States Patent
Crawford

(10) Patent No.: US 6,651,744 B1
(45) Date of Patent: Nov. 25, 2003

(54) BI-DIRECTIONAL THRUSTER PIG APPARATUS AND METHOD OF UTILIZING SAME

(75) Inventor: James R. Crawford, Lafayette, LA (US)

(73) Assignee: Superior Services, LLC, Harvey, LA (US)

( * ) Notice: Subject to any disclaimer, the term of this patent is extended or adjusted under 35 U.S.C. 154(b) by 0 days.

(21) Appl. No.: 10/114,439

(22) Filed: Apr. 2, 2002

Related U.S. Application Data

(63) Continuation-in-part of application No. 10/068,782, filed on Feb. 5, 2000, which is a continuation of application No. 09/185,988, filed on Nov. 4, 1998, now Pat. No. 6,343,657.

(60) Provisional application No. 60/067,503, filed on Dec. 4, 1997, and provisional application No. 60/066,380, filed on Nov. 21, 1997.

(51) Int. Cl.[7] ..... E21B 23/04

(52) U.S. Cl. ..... 166/311; 166/312

(58) Field of Search ..... 166/311, 312, 166/77.1, 77.2; 405/154.1, 184; 15/104.85

(56) References Cited

U.S. PATENT DOCUMENTS

| | | | | |
|---|---|---|---|---|
| 712,486 | A | 11/1902 | Black | 166/241.3 |
| 712,487 | A | 11/1902 | Black | 166/241.3 |
| 712,488 | A | 11/1902 | Black | |
| 712,901 | A | 11/1902 | Black | 166/241.4 |

(List continued on next page.)

OTHER PUBLICATIONS

*Extended Reach Pipeline Blockage Remediation*, Benton F. Baugh, Ph.D., P.E., John Illeman, Jim Bob Crawford, David McStravick, Ph.D., P.E., Wayne Warren; May 1998.

*Primary Examiner*—William Neuder

(74) *Attorney, Agent, or Firm*—Gregory C. Smith; Garvey, Smith, Nehrbass & Doody, L.L.C.

(57) ABSTRACT

A retrievable pig apparatus having a substantially cylindrical body portion, the body portion having a central flow bore therethrough, and secured to coiled tubing, including a central fluid flow bore in fluid communication with the interior bore of the coiled tubing; a plurality of flow bores spaced equally apart within the body, with the flow bores allowing fluid flow to be injected at a certain predetermined pressure through the flow bores, so as to be emitted on the front end of the pig for defining a high pressure spray of fluid or the like material to break up blockages of debris in the pipeline, such as paraffin or the like; the debris retrieved through the central bore back into the coiled tubing to be stored in a tank or the like on the surface. There is further included a plurality of flexible cups, spaced apart along the outer wall of the pig body, each cup secured to an interior metallic ring around the body of the pig, with the flexible cups making contact with the wall of the pipeline so as to provide continuous fluid seal between the wall of the pipeline and the ends of the plurality of flexible cups. Intermediate each cup there is provided a compressible safety ring, which will compress under excess pipeline pressure, thus allowing the fluid to flow past the plurality of flexible cups, reducing the pressure in the pipeline. Further there is provided within the plurality of six flow bores around the interior flow bore, for adjusting the force that is allowed to flow through the plurality of bores in either direction by providing a first and second thruster springs of a predetermined compressible force for allowing the spring to be compressed and effecting fluid flow therethrough in the direction in which the flow is to travel in the bores.

23 Claims, 11 Drawing Sheets

U.S. PATENT DOCUMENTS

| | | | | |
|---|---|---|---|---|
| 879,822 | A | 2/1908 | Karns | 175/325.3 |
| 1,281,756 | A | 10/1918 | Black | 166/241.3 |
| 1,801,294 | A | 4/1931 | Sutton | 166/241.3 |
| 1,913,365 | A | 6/1933 | Bailey | 175/325.3 |
| 2,887,118 | A | 5/1959 | Loeffler et al. | 134/112 |
| 3,056,155 | A | 10/1962 | Harmes | 15/104.06 |
| 3,089,434 | A | 5/1963 | Andreasen | 104/138 |
| 3,379,027 | A | 4/1968 | Mowell et al. | 405/154 X |
| 3,402,777 | A | 9/1968 | Watson | 173/147 |
| 3,467,196 | A | 9/1969 | Kinsman et al. | 166/315 |
| 3,495,546 | A | 2/1970 | Brown et al. | |
| 3,525,401 | A | 8/1970 | Hanson et al. | 166/384 |
| 3,729,057 | A | 4/1973 | Werner | 175/325.2 X |
| 3,763,896 | A | 10/1973 | Horne et al. | 15/104.061 |
| 3,827,487 | A | 8/1974 | Jackson et al. | 166/77 |
| 4,073,302 | A | 2/1978 | Jones | 134/167 |
| 4,360,290 | A | 11/1982 | Ward | 405/170 |
| 4,585,061 | A | 4/1986 | Lyons et al. | 166/77 |
| 4,729,429 | A | 3/1988 | Wittrisch | 166/65.1 |
| 4,756,510 | A | 7/1988 | Klamm et al. | 405/154 |
| 4,852,391 | A | 8/1989 | Ruch et al. | 405/154 X |
| 4,919,204 | A | 4/1990 | Baker et al. | 166/312 |
| 4,941,773 | A | 7/1990 | Vergouw | 405/154 X |
| 5,069,285 | A | 12/1991 | Nuckols | 166/311 |
| 5,180,009 | A | 1/1993 | Sneed | 166/383 |
| 5,188,174 | A | 2/1993 | Anderson et al. | 166/77 |
| 5,208,936 | A | 5/1993 | Campbell | 15/104.061 |
| 5,209,304 | A | 5/1993 | Nice | 166/383 |
| 5,309,990 | A | 5/1994 | Lance | 166/77 |
| 5,309,993 | A | 5/1994 | Coon et al. | 166/115 |
| 5,316,094 | A | 5/1994 | Pringle | 175/74 |
| 5,355,950 | A | 10/1994 | Zwart | 166/241.6 |
| 5,429,194 | A | 7/1995 | Nice | 166/383 |
| 5,445,224 | A | 8/1995 | Comeaux | 166/312 |
| 5,447,200 | A | 9/1995 | Dedora et al. | 166/311 |
| 5,494,103 | A | 2/1996 | Surjaatmadja et al. | 166/222 |
| 5,497,807 | A | 3/1996 | Rogers | 405/154 |
| 5,566,764 | A | 10/1996 | Elliston | 166/385 |
| 5,692,563 | A | 12/1997 | Krueger et al. | 166/85.5 |
| 5,695,009 | A | 12/1997 | Hipp | 166/196 |
| 5,704,393 | A | 1/1998 | Connell et al. | 137/614.21 |
| 5,992,250 | A | 11/1999 | Kluth et al. | 73/866.5 |
| 6,250,387 | B1 * | 6/2001 | Carmichael et al. | 166/311 |
| 6,260,617 | B1 | 7/2001 | Baugh | 166/241.3 |
| 6,315,498 | B1 | 11/2001 | Baugh et al. | 405/184 |
| 6,343,657 | B1 | 2/2002 | Baugh et al. | 166/383 |
| 2002/0095736 | A1 * | 7/2002 | Savard | 15/104.061 |

* cited by examiner

BI-DIRECTIONAL THRUSTER PIG APPARATUS AND METHOD OF UTILIZING SAME

CROSS-REFERENCE TO RELATED APPLICATIONS

This is a continuation-in-part of co-pending U.S. Pat. application Ser. No. 10/068,782, filed Feb. 5, 2002, which is a continuation of U.S. patent application Ser. No. 09/185,988, filed Nov. 4, 1998, now U.S. Pat. No. 6,343,657, which claimed priority from provisional patent application Ser. No. 60,066,380 filed on Nov. 21, 1997, entitled "Method and Apparatus of Injecting Coil Tubing Down Pipelines," and provisional patent application Ser. No. 60/067,503 filed on Dec. 4, 1997, entitled "Method and Apparatus of Injecting Coil Tubing Down Piplines," incorporated herein by reference.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The apparatus of the present invention relates to an apparatus for injecting tubing down a pipeline, well or open hole. More particularly, the present invention relates to a bi-directional thruster pig apparatus which is capable of injecting coiled tubing down a pipe in deep water to provide service to the pipe in order to remove blockages such as paraffin, hydrates, scale or solid debris. The pipe in question may be part of a vertical or horizontal well, pipeline or a combination of both. More particularly, the apparatus and method of the present invention provides a bi-directional thrust system by using changeable, adjustable check valves that are double acting in each direction, the amount of hydraulic thrust pressure being set and predetermined prior to the job or changed in the fields. The bi-directional fluid flow feature of the apparatus allows the apparatus to be retrievable from the pipeline after it has completed its cleaning function by eliminating or reducing any hydraulic or hydrostatic force against the pig as it is retrieved from the pipeline or well.

2. General Background of the Invention

Drilling for and producing subterranean oil and gas deposits and seeking out other energy sources, it is necessary to drill either vertical, horizontal, curved or a combinations of such, and then to insert an elongated tube from the surface deep into a pipe or the open hole. Such drilled holes may be part of, for example, a well, pipe line, production line, or drill pipe, depending on the circumstances. Quite often it is necessary to insert a tube, whether it be continuous or segmented into the pipe or open hole, the tube having a diameter smaller than the diameter of the drill, production pipe or open hole, in order to remove or destroy blockages which have formed in the pipe or drilled hole.

It has become very beneficial in the cleaning or clearing of pipelines, or horizontal holes to utilize a continuous tubing, referred to as coiled tubing. The tubing is usually injected type tubing which is relatively flexible, and is of a continuous length being rolled off a large reel at the rig site and down hole. Various types of tools may be connected to the end of the coiled tubing to undertake whatever task is required below the surface. Coil tubing strings can be joined together up to and exceeding ten miles at a time.

Large forces are often necessary to insert and withdraw thousands of feet or more of steel tubing into a pipe or open hole which may be filled with hydrocarbons or other materials.

Most apparatuses focus on the injector head located where the smaller tubing is injected into the larger tubing. The injector head grips the tubing along its length and, in conjunction with a motor, guides and forces the tubing into the pipe via, for example, a dual, opposing gripper chain or conveyor belt on the surface of the well. Injector heads are quite common in the oil and gas art, as found, for example, in U.S. Pat. Nos. 3,827,487; 5,309,990; 4,585,061; 5,566,764; and 5,188,174, all of which are incorporated herein by reference.

A common problem found in the art of injecting coiled tubing down a pipeline is that the tubing may be bent or kinked, i.e., the tubing becomes helical, down the well due to the large forces pushing against it and the weight of the tubing itself. is Furthermore, as the pipe becomes more horizontal, the weight of the coiled tubing itself no longer acts as a force pulling the tubing along, and instead acts against the wall of the pipe, creating friction. In addition, the weight of the tube no longer acts to straighten the coiled tubing, and the coil encourages coiling in the pipe. Such a coil, coupled with friction, results in increased force between the coiled tube and the inner diameter of the pipe, and this effectively binds the tubing. As a result of this and other problems, such prior art devices cannot effectively insert more than about 3,000 to about 5,000 feet (900 to 1500 meters) of tubing in substantially horizontal pipe.

Other methods have been employed to increase the length to which tubing can be injected. U.S. Pat. No. 5,704,393, describes an apparatus that can be set in the well at the end of the coiled tubing string at a determinable location. The apparatus is a valve apparatus, a packer apparatus, and a connector. Seals are provided that allow the coiled tubing, but not fluid, to move in a centrally located bore through the packer apparatus. The apparatus is immobile against the outer pipeline, and has the ability to restrict or prevent fluid flow. Once the packer is set, the annular pressure, i.e., the pressure differential between the pipeline and the interior of the coiled tubing, is increased by injecting fluid into the annular volume. This increased pressure stiffens and straightens the coiled tubing, allowing for increased distance of injection of coiled tubing into the pipeline.

Further, U.S. Pat. No. 6,260,617 issued Jul. 17, 2001 entitled "Skate Apparatus for Injecting Tubing Down Pipelines," teaches a device which is intermittently placed along the length of the coil tubing, and having a plurality of roller members which allows the coil tubing to be maintained within the center of the pipe in order to. reduce the friction between the coil tubing and the pipeline. However, over large distances over two or more miles, such a device is still not suitable.

All of the aforesaid problems confronted in the art of using coiled tubing down a borehole or pipeline can be found in related U.S. Pat. No. 6,315,498, entitled "Thruster Pig Apparatus For Injecting Tubing Down Pipelines," which is incorporated herein by reference. This patent discloses a method and apparatus for inserting and withdrawing coiled tubing from pipe to avoid bending or twisting of the coiled tubing at great distances downhole. There is provided a thruster pig that utilizes pressure differential across the thruster pig to generate force needed to inject the tubing down the pipeline. The pig includes one or more chevrons to impede fluid flow around the pig, so the pig can be pressured at its rear to move down the pipeline. There is provided an opening for allowing fluids pumped down the center of the tubing to pass to the front of the pig. There is further provided one or more valves in series or in parallel that slow the fluids to pass through the pig to the annulus behind the pig. There are a second set of check valves for allowing fluids under some conditions to flow from the annulus between the tubing and the interior surface of the pig to the front of the pig. These valves are limits of the pressure that can be exerted against the back of the pig, and will open to allow fluid to pass, principally when the pig is being withdrawn from the pipeline. This device, although effective, cannot be operated to allow the device to continue to simultaneously move forward in the pipeline while obstructions in the pipeline are being cleaned away. Also, unlike the present invention, the fluid under pressure is being injected through the bore of the coiled tubing through a single nozzle at the forward end of the pig, which limits its movement and cleaning ability in the pipeline. Also, there is no provision in this device to allow pieces of debris to flow up to the surface behind the pig, as the pig moves forward to destroy the obstructions in the pipeline.

BRIEF SUMMARY OF THE INVENTION

The apparatus of the present invention and the method of utilizing same solves problems in the art in a simple and straightforward manner. What is provided is a retrievable pig apparatus having a substantially cylindrical body portion, the body portion having a central flow bore therethrough. The rear of the body portion would be secured to the first end of a length of coil tubing and would include a central fluid flow bore in fluid communication with the interior bore of the coiled tubing. There is further provided a plurality of flow bores spaced equally apart within the body, with the flow bores allowing fluid flow to be injected at a certain predetermined pressure through the flow bores, so as to be emitted on the front end of the pig for defining a high pressure spray of fluid or the like material to break up blockages in the pipeline such as paraffin or the like. The debris which is formed from the breakup of the paraffin or the like would be retrieved through the central bore back into the coil tubing to be stored in a tank or the like on the surface. There is further included a plurality of flexible cups, which are spaced apart along the outer wall of the pig body, and each of a diameter equal to the interior diameter of the pipeline, each cup secured to an interior metallic ring which is slidably engaged around the body of the pig, with the flexible cups extending a distance out from the body of the pig and the ends of which making contact with the wall of the pipeline so as to provide a continuous fluid seal between the wall of the pipeline and the ends of the plurality of flexible cups. Intermediate use of the cup there is provided a compressible safety ring, so that should the pig encounter pressures to the point which may result in the rupture of the pipeline, the compressible members will compress thus allowing the fluid to flow past the plurality of flexible cups, reducing the pressure in the pipeline. Further there is provided within the plurality of six flow bores around the interior flow bore, a system for adjusting the force that is allowed to flow through the plurality of bores in either direction by providing a first and second spring member within the bores, each of the spring members having a pre-determined compressible force for allowing the spring to be compressed and effecting fluid flow therethrough and compressed. There is further provided a means on the rear portion of the pig for allowing a fishing tool to be secured onto the pig in order to remove the pig from the pipeline in the event the pig becomes stuck within the pipeline. When this is done, fluid flow is then allowed to flow in the opposite direction within the bores, thus allowing the pig to be removed from the pipeline during use. As will be seen from the following Objects of the Invention, this improved thruster pig has many attributes which are improvements from the thruster pig disclosed in U.S. Pat. No. 6,315,498, as referred to earlier.

It is a principal object of the present invention to provide a bi-directional thruster pig apparatus, capable of attaching to a continuous coiled tubing and pull the coiled tubing a distance down a well, pipeline, or drill hole for a distance of ten miles or greater;

It is a further object of the present invention to provide a safety collapse system comprising a UMHW armature support system on each cup designed to compress and allow the cups to collapse when excessive pressure is applied, which can be predetermined to prevent any over pressure of the annulus;

It is a further object of the present invention to provide a bi-directional thrust system comprising changeable, adjustable check valves that are double acting in each direction, the amount of hydraulic thrust pressure being set and predetermined prior to the job or changed in the fields;

It is a further object of the present invention to provide a plurality of double acting check valves in the "coiltac" thruster pig which would allow thrusting the coil tubing down a pipeline, hole or well at distances greater than 10 miles while washing out in front of the thruster as it moves ahead and behind it while pulling the thruster out of the pipeline, well or hole;

It is a further object of the present invention to provide double acting check valve system within the thruster pig which would allow to spray chemicals in front of the thruster pig down the coil tubing or when returning back through the pig up the annulus side, which is more economical and faster than pumping chemicals down the annulus side;

It is a further object of the present invention to provide thruster pig which allows setting the return flow check valve in the thruster to pre-set hydraulic thruster force that will help to thrust the coil tubing or pipe back down the line, thus eliminating most of the cat head or key seating frictional drag back through a radius;

It is a further object of the present invention to eliminate not only the helical bucking of the coil tubing or pipe as it is propelled down the line but also prevent yielding of the coil tubing or pipe as the thrust pressure is safely set before the jobs using the mechanical intelligence of the check valve settings;

It is a further object of the present invention to provide a thruster pig which has no metal parts that can be broken off or lost in the well or line;

It is a further object of the present invention to provide a thruster pig which can be completely dressed out and rebuilt in the field if necessary, with all double acting check valves and the collapse system being changed out, rebuilt or reset in the field;

It is a further object of the present invention to provide three or more flexible cups which can be added to the system to insure better wear for long distance runs down the pipeline well;

It is a further object of the present invention to provide a new thruster pig which may include an internal built in profile for releasing from the pig and fishing it from the line;

It is a further object of the present invention to provide a new thruster pig system which can be as short as 12 inches and still maintain thruster power to propel the coil tubing or pipe up to and beyond ten miles, while allowing the system to work through a short bend radius including but not limited to a 5D radius;

It is a further object of the present invention to provide a system that can use cups or tapered or bi-directional thrusters;

It is a further object of the present invention to provide the special molded cups designed for the thruster which can be dressed out to service a plurality of pipe sizes, for example, 6", 8", 10" and 12" and other sizes;

It is a further object of the present invention to provide a thruster pig which can generate hydraulic forces great enough to propel the coil tubing or pipe down a well a greater distance than ten miles as required and can be utilized with or without skates.

It is a further object of the present invention to provide a bi-directional thruster pig apparatus, which would allow fluid flow through the pig in two directions simultaneously, for allowing the pig to move forward within the pipeline or to be retrieved from the pipeline as the case may be;

It is a further object-of the present invention to provide a thruster pig apparatus having a compression safety release system, for allowing pressure buildup within the pipeline to compress a portion of the pig and to relieve the pressure within the pipeline;

It is a further object of the present invention to provide a thruster pig apparatus, having a plurality of outer flow channels for allowing fluid flow to flow under pressure out of the front portion of the pig and having a central flow bore for allowing the fluid flow to return rearwardly through the pig into a coil tubing and stored in a tank above ground;

It is a further object of the present invention to provide a thruster pig apparatus attached to the end of coil tubing which through a method of pushing the pig through the pipeline via pressure at the rear of the pig allows the pig to carry the coil tubing along the pipeline for distances greater than ten miles yet eliminate buckling or coiling in the coil tubing during use.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein:

FIG. 10 illustrates a cross section view of the pig apparatus of the present invention being inserted with a fishing tool or the like;

DETAILED DESCRIPTION OF THE INVENTION

Figure 1:
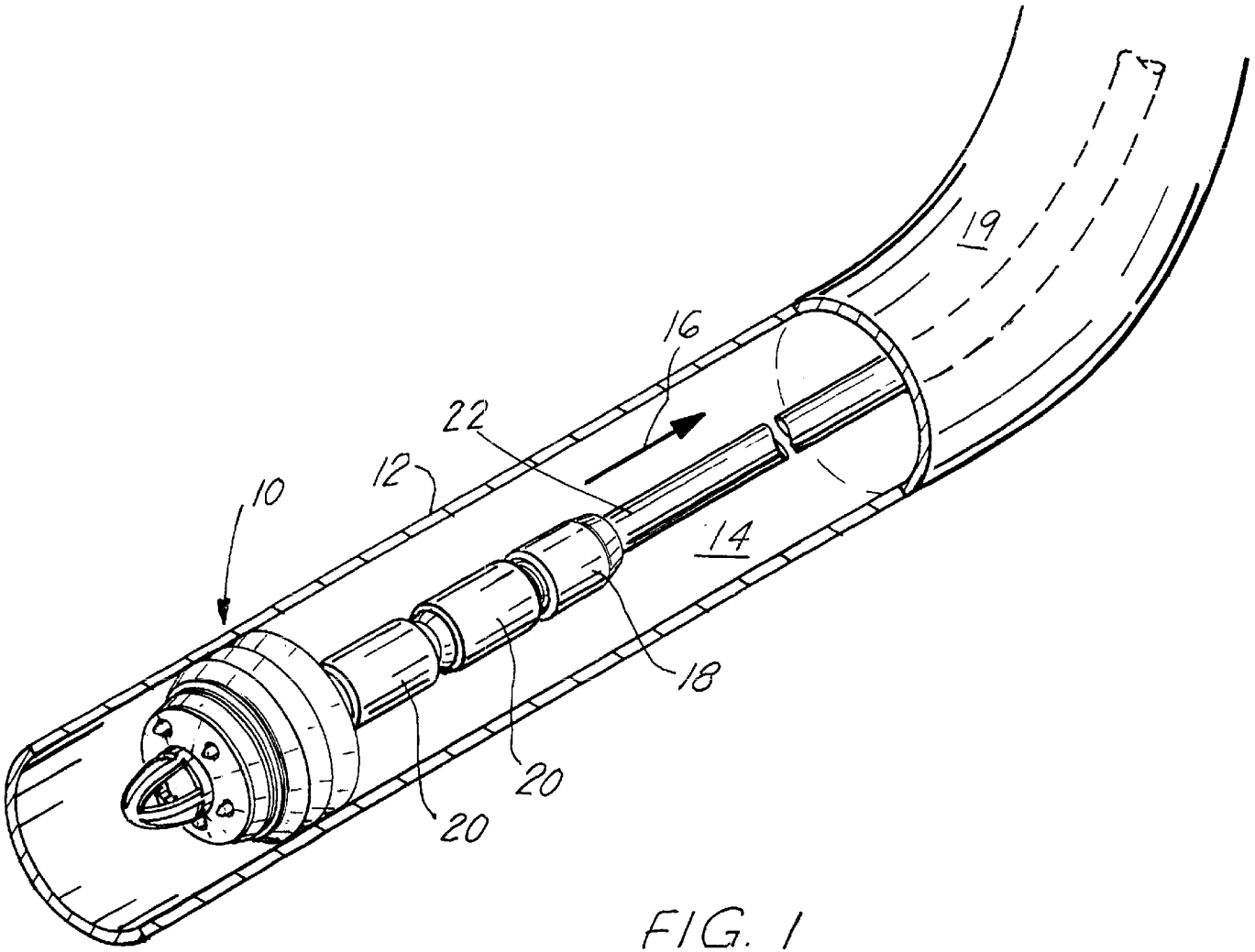
FIG. 1 illustrates an overall cutaway view of the thruster pig apparatus of the present invention at the end of coiled tubing within a pipeline.

FIGS. 1–12 illustrate the preferred embodiment of the apparatus of the present invention and the method of using same. As illustrated in overall cutaway view in FIG. 1, there is illustrated the thruster pig apparatus 10, hereinafter commonly referred to as the apparatus 10, which is positioned within a pipeline 12, which is normally a segmented pipeline or casing which has been drilled either vertically, horizontally, or a combination of the two, for a great distance up to fifty or sixty thousand feet, or greater, in order to retrieve hydrocarbons through the bore 14 of the pipeline up to the surface, in the direction of arrow 16. The pipeline, as illustrated, includes a continuous circular wall portion 19 and, as was stated earlier, has a bore 14 therethrough. As seen in FIG. 1, pig apparatus is secured at the end of a length of coiled tubing 22 which is commonly found in the oil and gas industry. Coiled tubing 22, as well known in the art, is a continuous length of somewhat flexible tubing which is reeled off of a reel on the rig floor, and is allowed to continuously reel the coiled tubing down the pipeline for various uses. Although the preferable manner for maneuvering the pig apparatus 10 downhole is through the use of coiled tubing 22, other types of pipe strings could be used in the method described herein.

Figure 2:
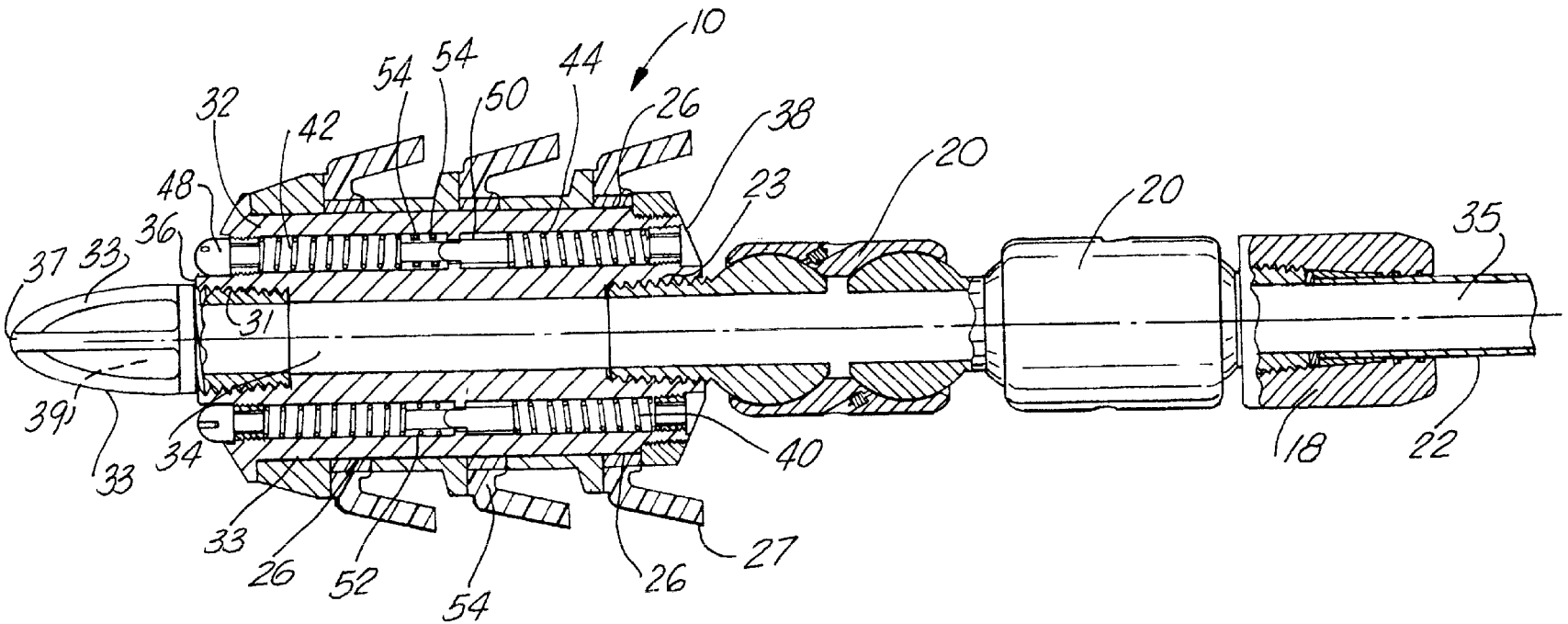
FIG. 2 illustrates a cross section cut away view of the preferred embodiment of the thruster pig apparatus of the present invention secured to the end of coiled tubing.

As seen in FIG. 1 and also in view in FIG. 2, the coiled tubing 22 is secured first to a hydraulic release mechanism 18, which is commonly known in the art, and serves to allow the pig apparatus 10 to be released from the coiled tubing in the event the pig becomes lodged down the pipeline 12. The hydraulic release mechanism 18 is secured to a first knuckle joint 20, which is in turn secured to a second knuckle joint 20, the knuckle joints 20 function to allow the pig at the end of the coiled tubing 22 to make a critical bend in the pipeline. The second knuckle joint 20 would be threadably secured to the pig apparatus 10 through a threaded member 23 as seen in FIG. 2.

Figure 12:
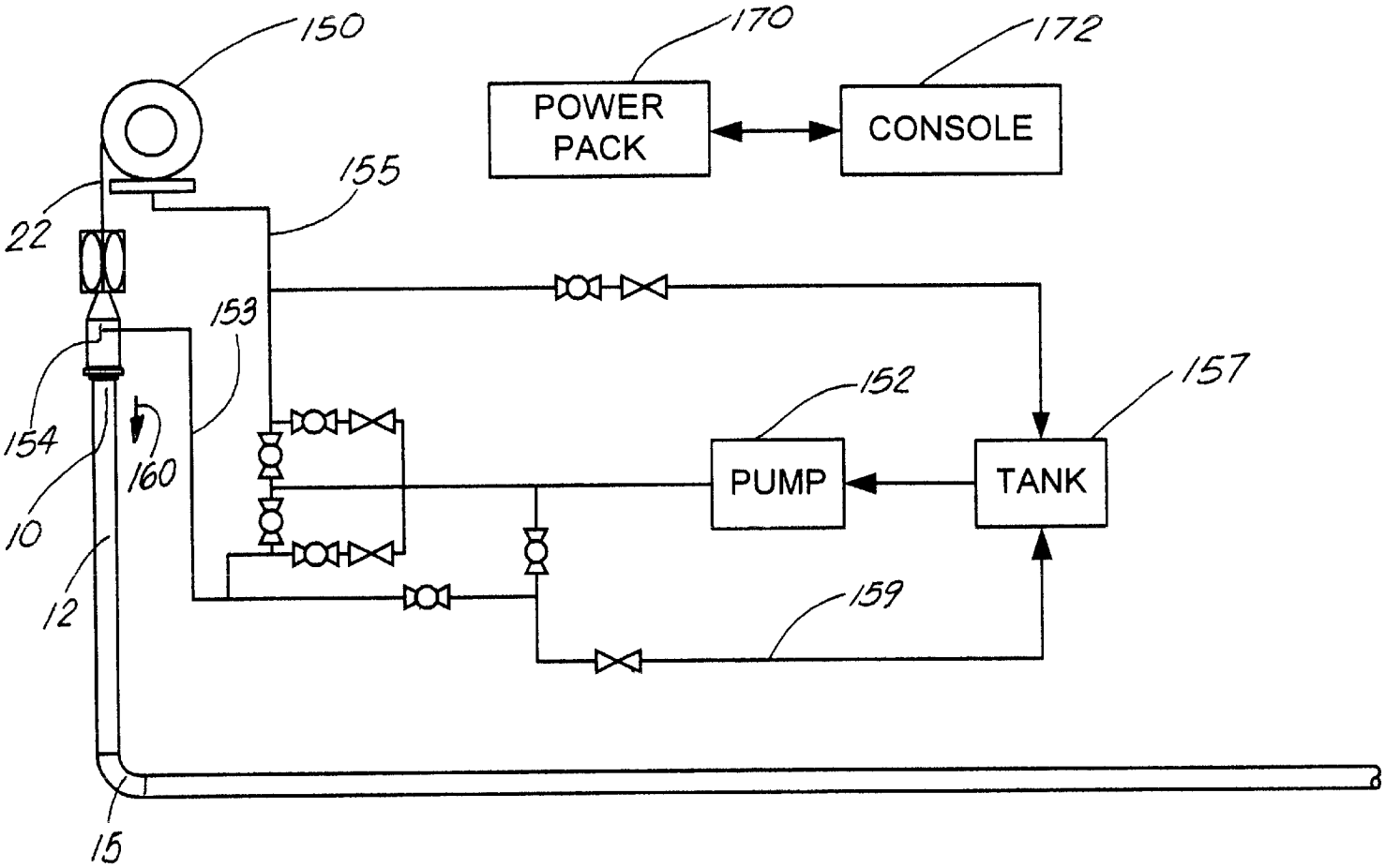
FIG. 12 illustrates the mock up of the entire system which is utilized in achieving the method of moving the pig into the pipeline and retrieved from the pipeline during use.

The importance of using the knuckle joints 20 in the makeup between the coiled tubing 22 and the pig apparatus 10 is best explained by making reference to FIG. 12. In FIG. 12, where the entire system layout is illustrated, pipeline 12 makes a 90 degree bend at point 15, which is known in pipeline work as a 5D (Diameter) bend. In order for the pig apparatus 10 at the end of a coiled tubing 22 to make that bend, the two knuckle joints 20 are required so as to facilitate the pig apparatus 10 moving around the 5D bend, in order to proceed down the horizontal or vertical pipeline 12. Although the pig, in this embodiment is maneuvering around a 5D bend, it is foreseen that there are other size bends which may be maneuvered around depending on the size of the pipeline.

Reference is now made to FIGS. 2–5 which illustrate in detail the pig apparatus 10 as illustrated. First returning now to FIG. 2, apparatus 10 includes a substantially cylindrical body portion 32, having a principal central flow bore 34 therethrough from the front end 36 of the apparatus to the rear end 38 of the apparatus. As illustrated, flow bore 34 flows continuously as a continuous flow bore through the knuckle joints 20, the hydraulic release mechanism 18, and into the bore 35 of the coiled tubing 22 up to the rig floor. The functioning of the bore will be explained further. At the front end 36 of apparatus 10 there is provided a nose member 29 threadably secured to apparatus 10 by threaded portion 31, and having a plurality of spaced apart arms 33 terminating in end portion 37, defining a plurality of fluid flow spaces 39 between arms 33, for allowing flow through spaces 39 into flow bore 34 for reasons as will be explained further.

Figure 3:
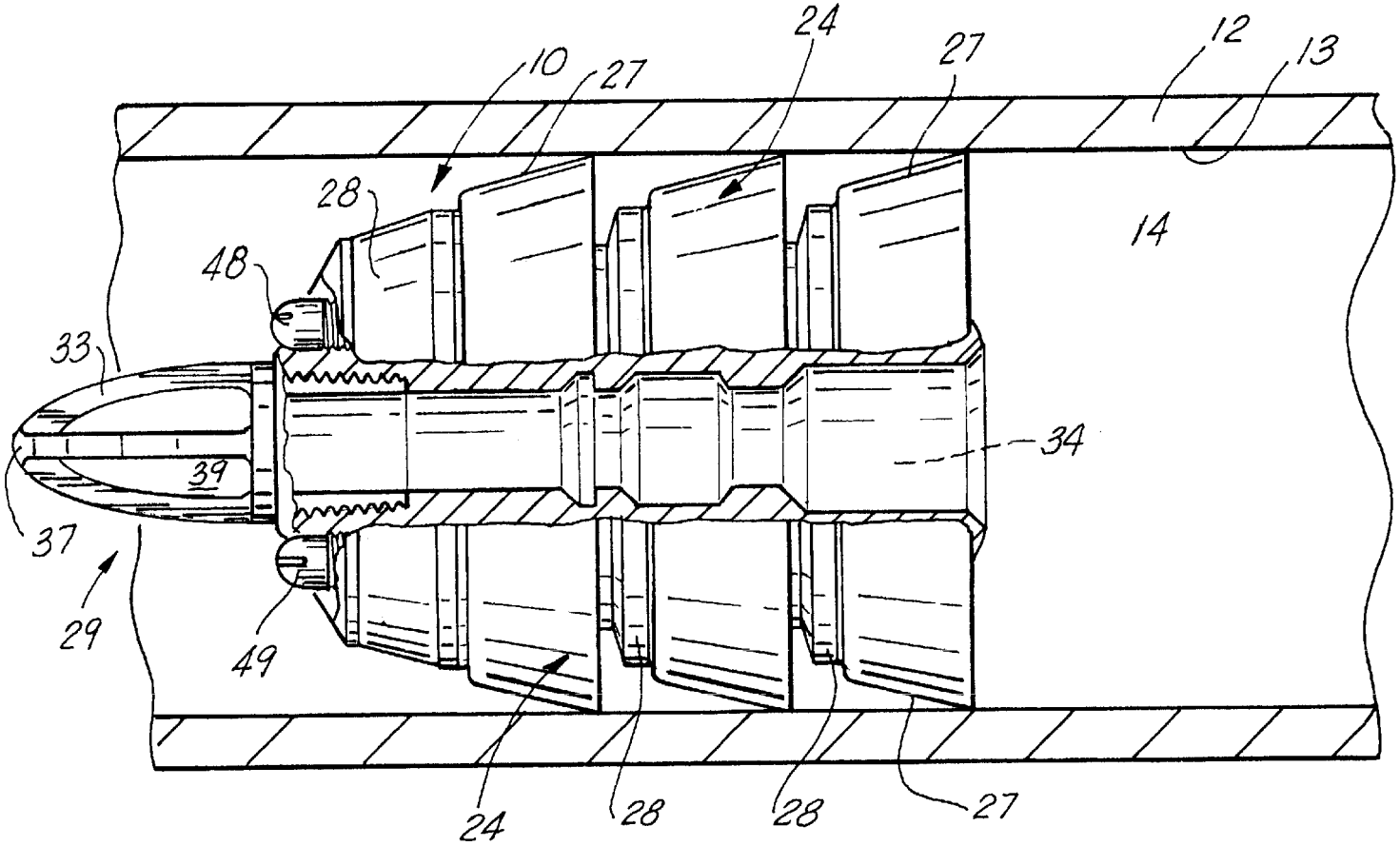
FIG. 3 illustrates an additional partial cross sectional view of the apparatus of the present invention showing the central interior bore through the apparatus.
Figure 4:
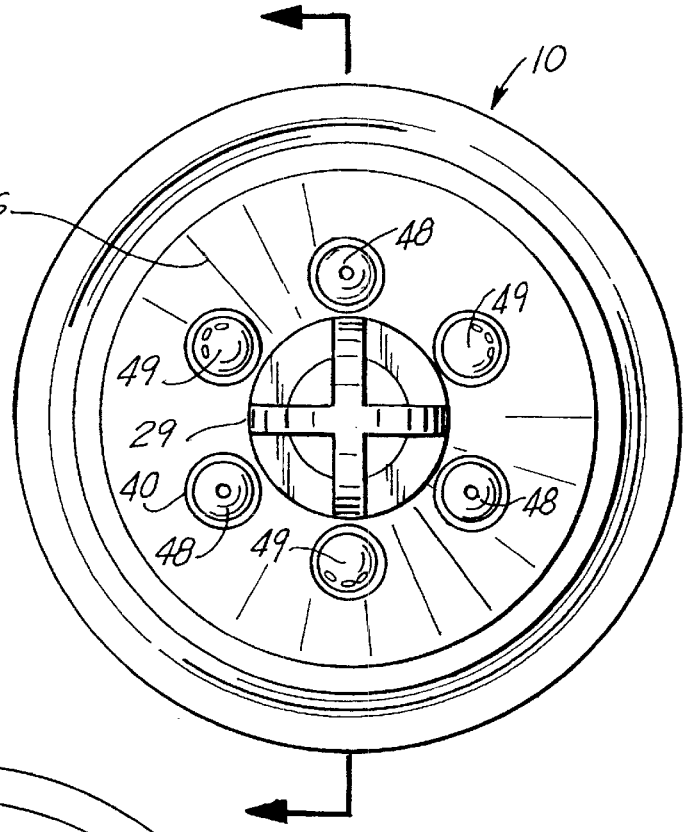
FIGS. 4 and 5 illustrate front and rear views respectively of the preferred embodiment of the pig thruster apparatus of the present invention.

As seen clearly in FIGS. 2 and 3, the pig apparatus 10 further comprises a plurality of spaced apart flexible cups 24.

The cups 24 would be constructed of durable, flexible material, such as polyurethane or the like material. Each cup 24 is circular in cross section, and including a circular body portion 25 secured to an inner metal ring member 26, which is secured around the outer wall of the pig body 32. Each cup 24 further includes a flared portion 27 extending outward from the body 25 of each cup 24, and making contact along the inner surface 13 of the pipeline 12, so as to define contacting engagement with the surface 13, as the pig is traveling within pipeline. 12 under pressure, and no fluid being allowed to pass there between.

Figure 5:
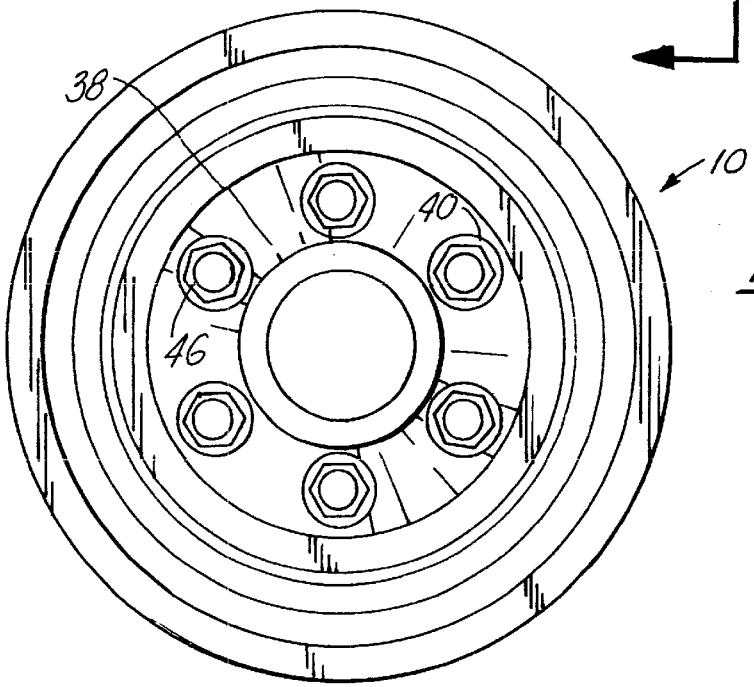
Figure 6:
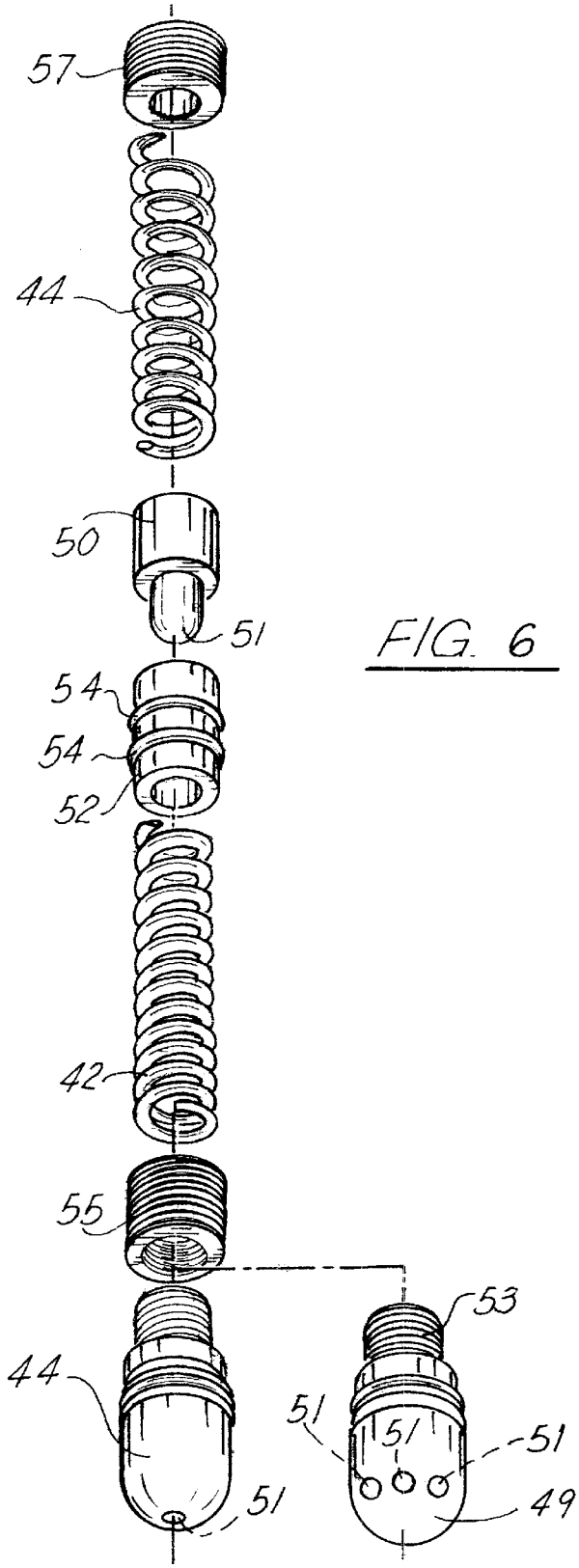
FIG. 6 illustrates an exploded view of the components contained in one of the plurality of outer bores within the thruster pig apparatus.

Further as illustrated in front and rear views in FIGS. 2 through 5, there is a plurality of outer flow bores 40, each of the flow bores 40, as seen in the Figures, extending from the front end 36 of the apparatus to the rear end 38 of the apparatus 10. As is illustrated, each of the flow bores 40 define a system for allowing fluid under pressure to flow in either direction within flow bores 40, as will be explained further. The system in each flow bore 40 comprises a first forward thruster spring 42, a rear reverse thruster spring 44, with the rear spring 44 held in place via a nut 46, as illustrated in FIG. 5, and a forward string 42 held in place via a nozzle members 48, 49 threadably engaged within the bore 40 of the apparatus.

As further illustrated in detailed view, positioned between springs 42, 44, there is a movable piston member 50 securable within a collar 52, the sealing body 52, having a pair of O rings 54, for allowing or blocking fluid flow therethrough depending on the pressure in the system. The functioning of each of the flow bores 40, housing the elements as discussed above will be addressed more fully below in reference to FIGS. 8 and 9 in the application.

Before explaining the pig apparatus 10 during operation, reference is now made to FIGS. 6 and FIGS. 7A through 7C, which explains in detail the functioning of the components within each of the outer bores 40 of the pig apparatus 10. As in seen in FIG. 6 in exploded view, was seen earlier in relation for FIG. 5, there are a total of six bores 40 within the body of pig 10, three of the nozzles 48 having a single bore 51 therethrough for directing fluid flow directly forward of the pig apparatus 10, and each of the other three nozzle members 49 having a plurality of three bores 51 therethrough so as to effect a spray outwardly from the nozzle making contact with the wall of the casing as was seen in FIGS. 6 and 8. The nozzle members 48 and 49 would be alternated within body 32 of pig 10 and would be threadably engaged via a stem member 53 which is threaded into the forward threaded opening 55 of the bore 40 as seen in FIG.

Figure 7A:
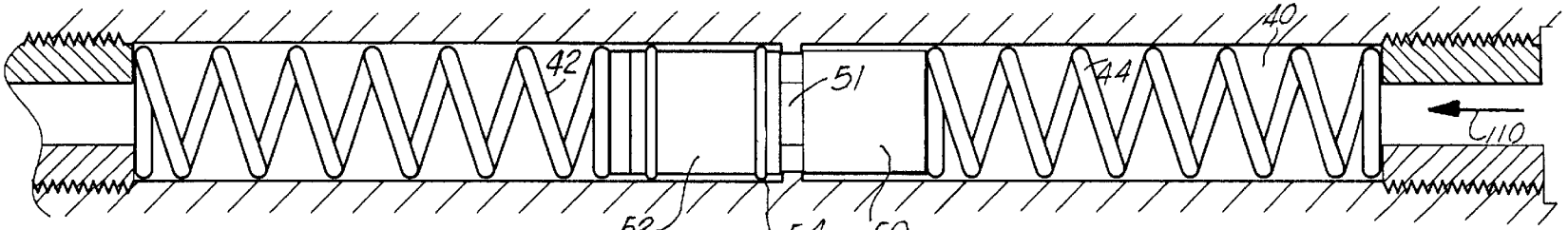
FIGS. 7A through 7C illustrate the fluid flow through one of the outer bores on the thruster pig body depending on the pressure within the bore.
Figure 7B:
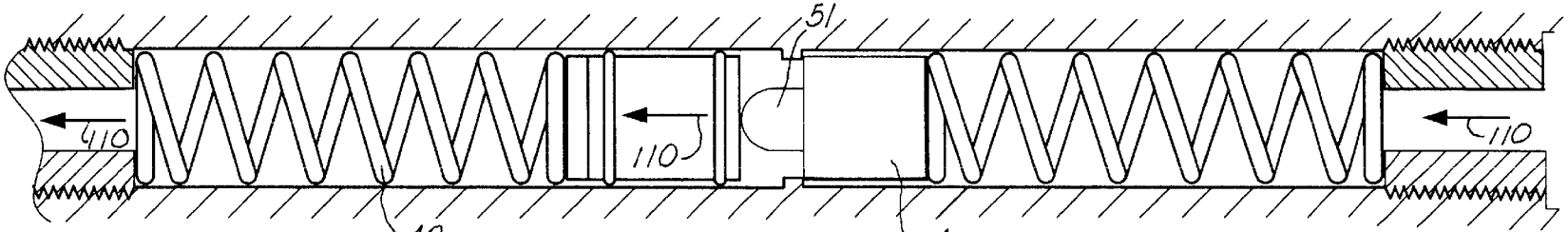

In the operation of the fluid pressure system, reference is made to FIG. 7. As illustrated in FIG. 7A, the thruster spring members 42 and 44 are in place within bore 40, and the piston member 50 is engaged within the sealing body 52 and sealed in place against O rings 54, allowing no fluid flow unless subjected to a predetermined amount of fluid force. Reference is now made to FIG. 7B where rear spring 44 has been subjected to fluid force to allow the spring 42 to be compressed. It is foreseen that the preferred force would be 450 lbs. of force, although the amount of force may be increased or decreased depending on the situation. When the pre-determined force has been applied, the front spring 42 would be compressed, and the piston 50 would be disengaged from the O-rings 54, allowing the fluid to flow within the space 40, bypassing the seal between the O rings 54 in the direction of arrow 110, and out of the forward portion of each of the nozzles 48, 49 as illustrated. This would be the type of flow that would occur when the operation of the pig 10 will be discussed in reference to FIG. 8.

Figure 7C:
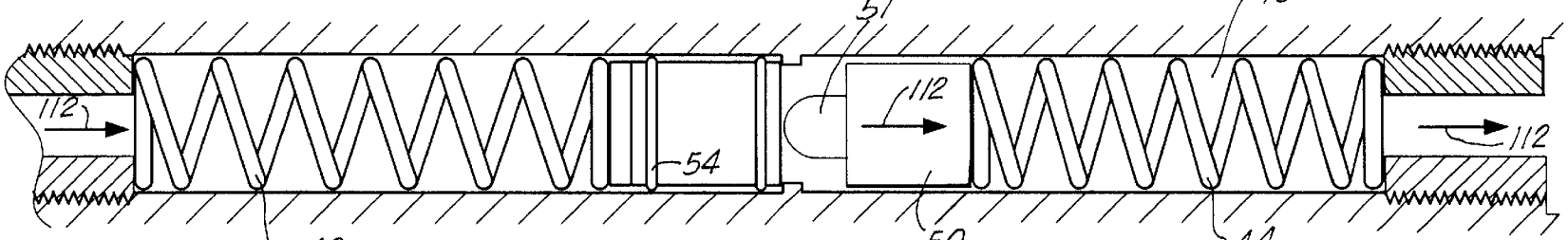

FIG. 7C illustrates the fluid flow through bore 40 in the reverse direction to FIG. 7B, in the operation of the pig 10 as will be discussed in relation to FIG. 9. As seen in FIG. 7C, the principal fluid flow would be flowing forward through the inner bore 34 of pig 10 and would return via the plurality of outer bores 40. When this occurs, fluid flow as seen in the direction of arrow 112 in FIG. 7C, the thruster spring 42, together with the fluid flow, would compress the rear thruster spring 44 thus dislodging the member 50 from sealingly engaging O rings 54 and by that would allow the fluid flow at 112 to flow through the entire bore 40 in the direction of arrow 112 and be returned into the flow passage 14 of casing 12. It is foreseen that the preferred force would be approximately 150 lbs of force on the thruster spring in order to compress the rear thruster spring 44, although the amount of force may be increased or decreased depending on the situation. It is through this combination of fluid flow through the predetermined compression springs that would determine the amount of pressure required to allow flow to flow in either direction as the case may be.

Figure 8:
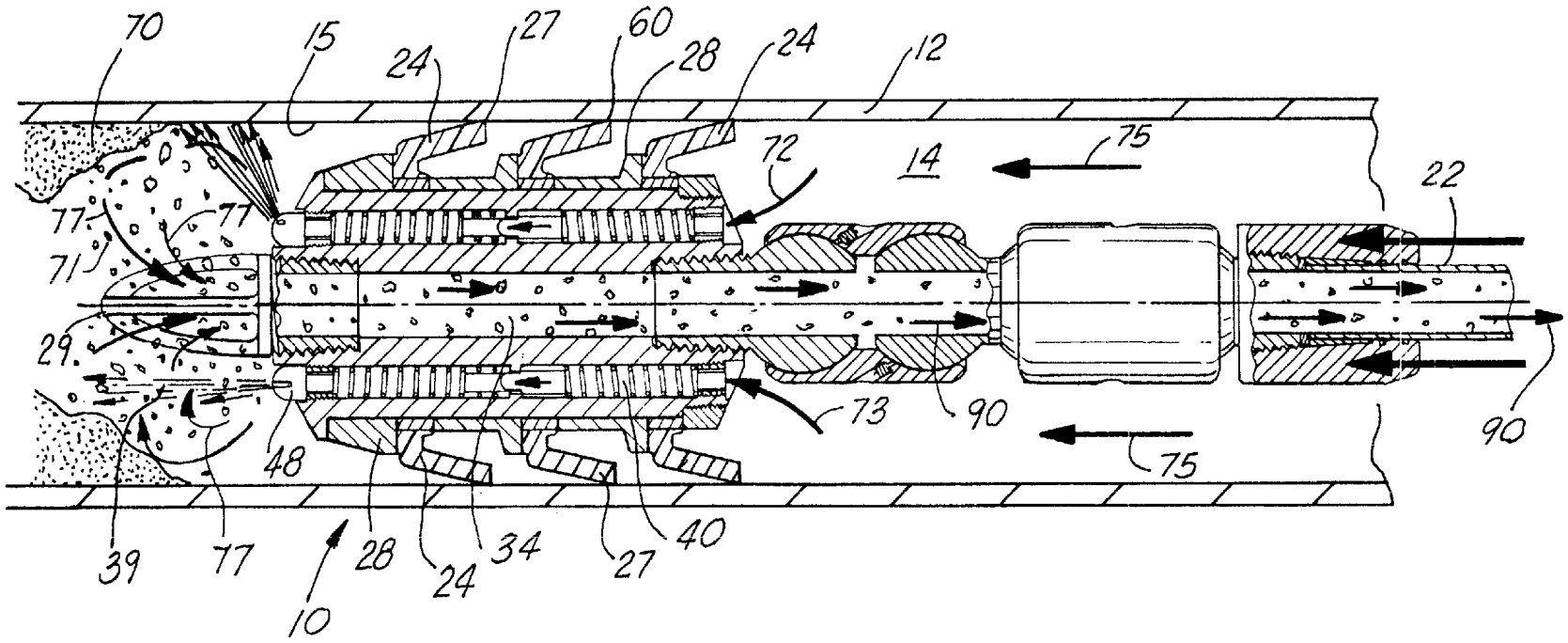
FIG. 8 illustrates a view of the thruster pig apparatus of the present invention during use of the apparatus while the apparatus is moving through the pipeline to clean debris which has been lodged within the pipeline.
Figure 9:
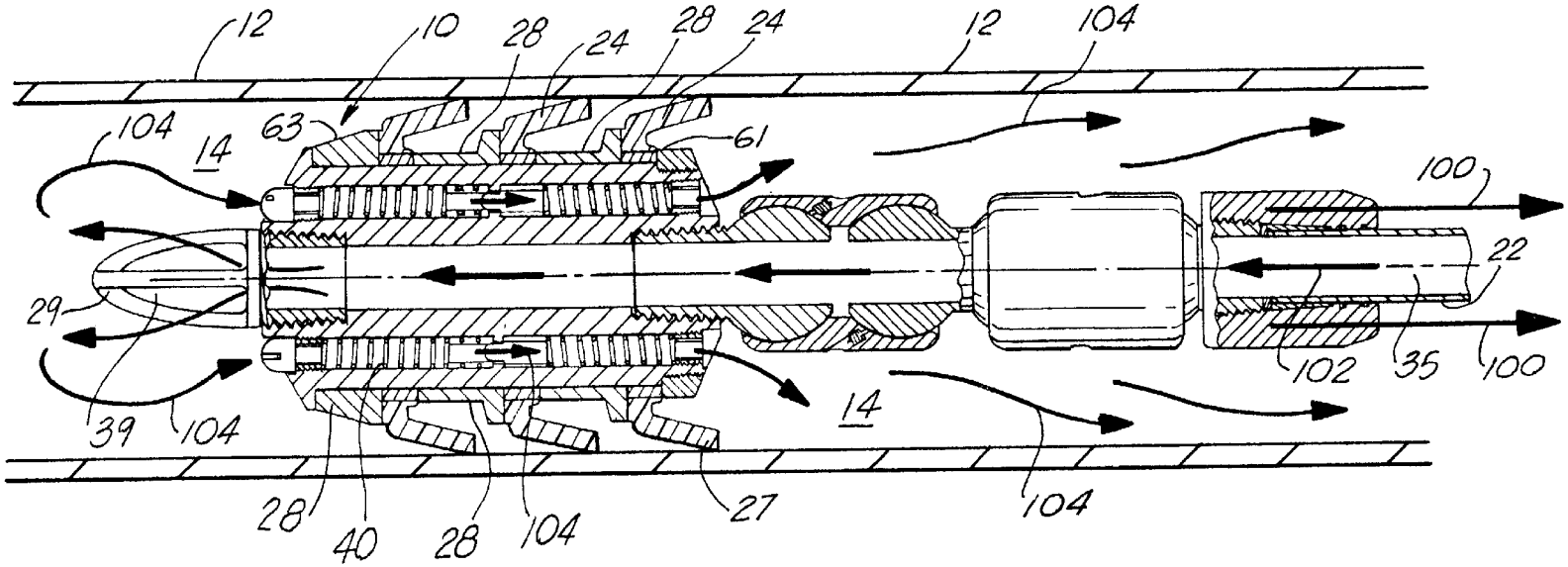
FIG. 9 illustrates cross section view of the preferred embodiment of the apparatus of th present invention being retrieved from the pipeline where fluid flow is reversed through the pig in order to accomplish same.

Reference is now made to FIGS. 8 and 9 for an understanding of the operation of the apparatus when it is in place within the pipeline 12 as seen in FIG. 1. Turning first to FIG. 8, pig apparatus 10 is positioned within the interior 14 of pipeline 12, he plurality of cup members 24, preferably three in number having their outer flared cup portion 27 making contact with the inner surface 15 of pipeline 12, throughout the continuous surface of wall 15, so as to block fluid flow between the pig 10 and the inner surface 15 of pipeline 12.

As illustrated in FIG. 8, the apparatus 10 would positioned again as was stated earlier onto the end of the coiled tubing 22, and fluid pressure, at a predetermined pressure would be injected into the pipeline behind the pig 10, and the pressurized fluid would push the pig forward in the pipeline 12, with the pig 10 pulling the coiled tubing 22 along as it traveled forward. In the particular view in FIG. 8, pig 10 has encountered debris 70, such as paraffin, hydrates, scale, other solid debris, or the like material, which is lodged in the interior of the pipeline and needs to be removed. For purposes of operation, the pig at the end of the coiled tubing 22, is being subjected to a fluid force in the direction of arrows 75 at its rear, so that the fluid force of the fluid from the rig floor within the interior 14 of pipeline 12 is pushing the pig along and the pig is in effect is pulling the coiled tubing along as it moves forward. As illustrated, when the pig encounters an obstruction 70, the pressure behind the pig 10 would be increased to an amount of approximately 450 lbs./sq. in. At this point the pressure would be sufficient to place into operation the six bores 40, in the manner described in FIG. 7A, and fluid would flow out of the six nozzles 48, 49, directing a fluid spray under pressure against the pipeline wall 13 and the debris 70, breaking up the debris into small pieces 71 in its path. The debris would be carried by the fluid flow in the direction of arrows 77 through the openings 39 within nose member 29 of pig 10, and channeled rearwardly through the pig within center bore 34 to ultimately move up the bore 35 of the coiled tubing 22 up to the surface in the direction of arrow 90. In this manner, the pig 22 is being forced along by the rearward force of fluid under pressure and is breaking up debris as it is encountered by the pig.

Turning now to FIG. 9, again the pig apparatus 10 is within space 14 of pipeline 12. In this particular view, after the pig has completed its work as described in FIG. 8, the pig is being actually retrieved from the pipeline in the direction of arrows 100 as seen in the figure. This is accomplished by allowing the fluid flow within the space 35 of the coiled tubing 22 to flow in the direction of arrow 102 and ultimately through the central bore 34 of pig 10. The fluid would flow out of the openings 39 in nose member 29 and would then return fluid flow through the openings in nozzles 48, 49 through each of the outer bores 40 in the direction of arrows 104 and into the space 14 around pig apparatus 10 and upward through the casing. This is opposite of the fluid flow which took place in FIG. 8 where the fluid flow through the casing and returned up the interior of the coiled tubing 22. In FIG. 9, the forward fluid flow is through the bore 34 of the pig 10 and returned through the plurality of outer bores into the fluid flow space 14 of the casing and therefore the fluid is returned through the casing which goes through the coiled tubing 22.

One of the features of the apparatus 10 which has yet to be discussed is the fact that often times the pig apparatus may encounter pressures within the pipeline which could, in the worst event, cause damage to the pipeline or even rupture the pipeline. Rather than this occur, reference is made to the pig apparatus where each of the cup members 24 are held in place with a compressible safety ring 28 as seen particularly in FIGS. 8 and 9. Should the pressure build up within the pipeline, the compressible rings 28 would compress and therefore allowing the plurality of rings 60 to allow fluid flow to flow by the cups 24 and therefore not form a seal which would cause a rupture of the pipeline.

Another feature of the apparatus is the fact that each of the rings 24 which is secured around the body of the pig are secured to an interior metal ring 26 as seen in the figures. This metal ring 26 is of various widths, depending on the size of the pipeline that the pig has to fit into. Therefore, in order to maintain each of the rings 24 in the flexible feature at a constant, the ring 26 may have to fit on different diameter pig bodies in order to fit into certain diameter pipelines. Therefore, the metal rings 26 are of various thicknesses between the flexible ring 24 and the pig body to accommodate for the smaller or larger spaces within the pipeline.

Figure 10:
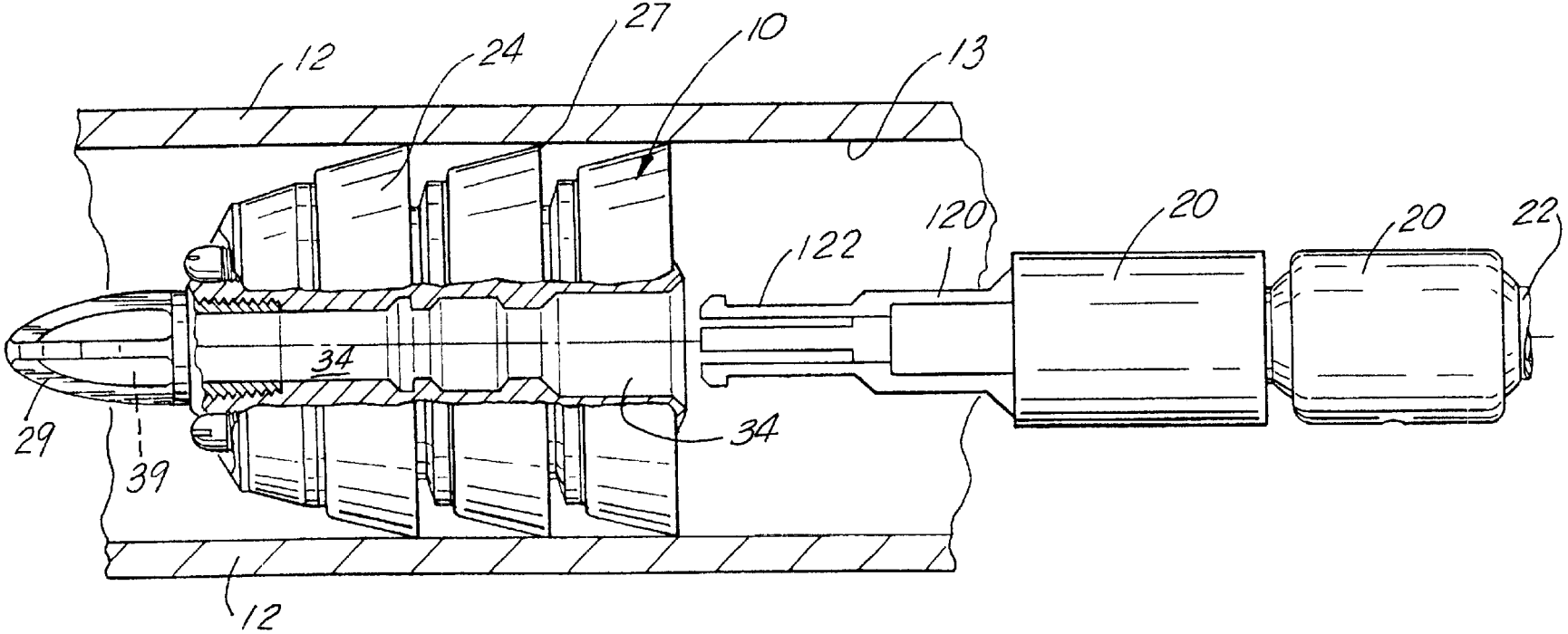
Figure 11:
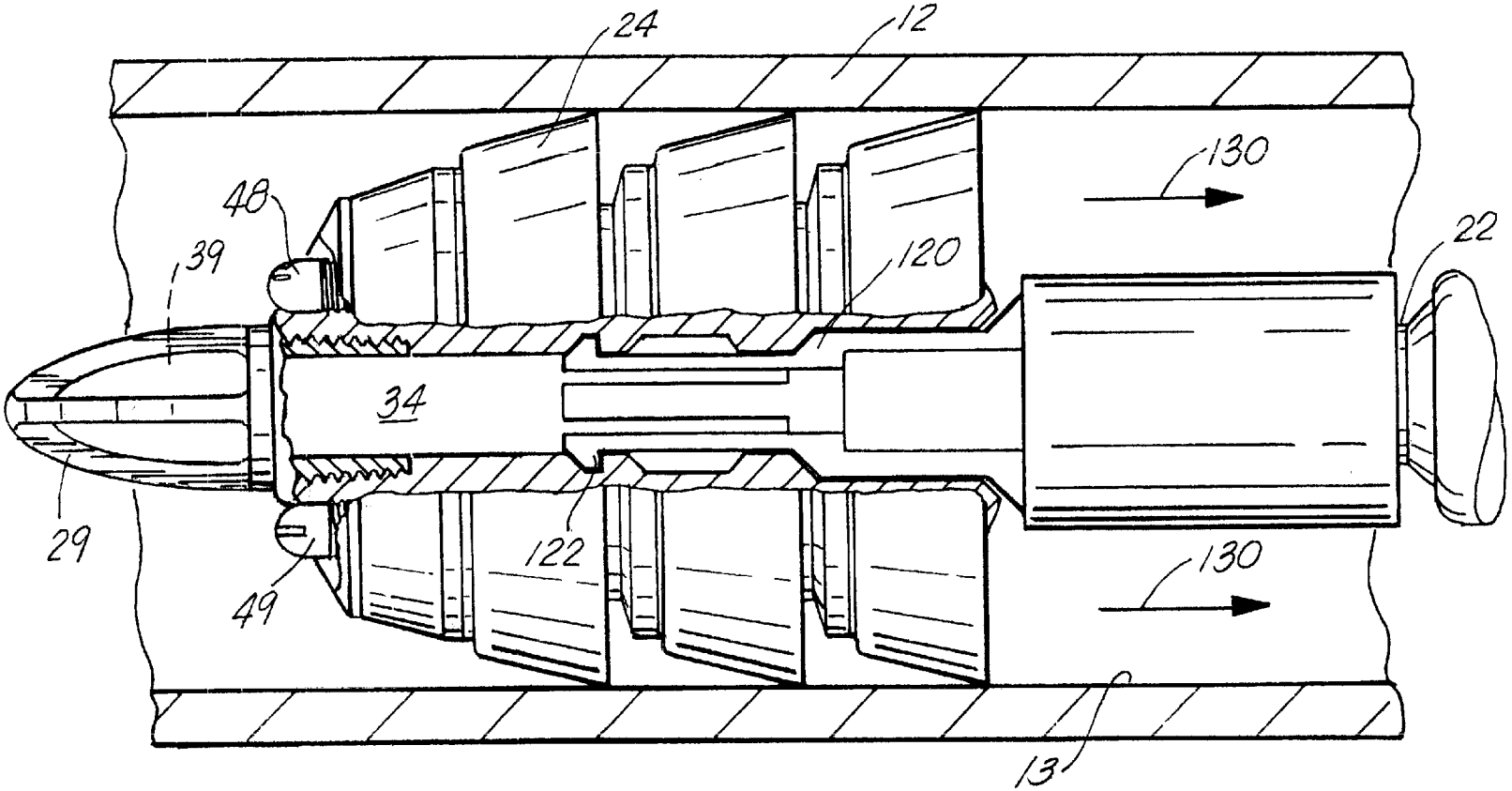
FIGS. 11 illustrates an additional view of the truster pig apparatus after the fishing tool has been locked into the thruster pig apparatus for retrieval from the pipeline.

Reference is now made to FIGS. 10 and 11 where there is illustrated a view of the pig apparatus 10 for example lodged within the pipeline 12 as the case may be. In order to retrieve the apparatus 10, one would first activate the hydraulic release mechanism 18, from the rig floor, in a manner known in the art, so as to release the pig 10 from the coiled tubing 22. As seen in FIG. 10, the operator would then send a fishing tool 120 at the end of the coiled tubing 22 downhole. The fishing tool 120 would include a grabber end 122 which would be insertable into the bore 34 of pig 10 and would be locked in place within the bore 34 of pig 10 within pipeline 12 as seen in FIG. 11. Once this is achieved, the coiled tubing 22 or like would be reeled back in the direction of arrow 130 as seen in FIG. 11 and the pig 10 would be retrieved. Again, if there were fluid or the like which would be encountered, the fluid flow could flow in the direction as was described earlier in relation to FIG. 9 as the pig was being retrieved from the pipeline.

METHOD OF THE PRESENT INVENTION

The truster pig apparatus 10 of the present invention, as disclosed in the specification, together with its additional embodiments would be utilized in a pipeline, such as is normally would contain a 5D radius, or other size radius. The pig apparatus 10 would be secured to a continuous length of coiled tubing 22, including at least one hydraulic release mechanism and a pair of ball or knuckle joints 20 so as to enable the pig to negotiate around the 5D radius in the pipeline.

The pig would be outfitted with thruster springs 42, 44 in the six flow chambers, the springs preferably set at 450 psi and reverse thrust springs 44 set for 150 psi, although the settings may vary depending on the fluid flow pressure required. Preferably, three of the flow chambers 40 will have one ¼" nozzle 48 pointed straight down, parallel to the pipeline, and three, alternating chambers 40 having ⅛" nozzles 49, each angled to cover the entire circumference of the pipeline which washing ahead. The size and number of flow nozzles 48, 49 associated with the pig may need to be changed depending on the circumstances of the job to be undertaken.

After the pig 10 is secured to the coiled tubing 22, fluid pressure is provided at the rear of the pig, and the plurality of cups 24, whose outer ends contact the wall of the pipeline, would allow the pressurized fluid to push the pig forward within the pipeline. As-long as the fluid pressure remained under 450 psi, the thruster springs within the flow chambers would not be activated. As stated earlier, the two ball or knuckle joints would allow the pig to negotiate around the 5D section 15, as seen in FIG. 12, and would then fluid pressure would continue to push the pig forward. When the pig would encounter an obstruction, such-as paraffin, the pressure would be increased so that the thruster springs would be compressed, and the fluid would flow through the flow passages, and exit through the six sets of nozzles, thus creating a fluid flow under pressure directed circumferentially at the obstruction, to dissolve or break it up. The fluid, containing the obstructed material would return through the inner flow bore 34 in pig 10, rearwardly, into the coiled tubing 22, and up to the surface, to be collected in collection tank or the like.

This process would be continued until the pig has traveled down the entire pipeline, pulling the coiled tubing with it. Because of the unique combination, the pig would be able to travel for 50,000 to 60,000 feet, or greater, to accomplished its task. When the task is completed, the pig is pulled up to the surface by reeling in the coiled tubing. Fluid flow would be reversed in the flow bores, so that fluid would be pumped down the coiled tubing through the bore 34 and out of the forward end in pig 10. Upon reaching at least 150 psi in front of the pig, the thruster springs would be activated, to allow fluid to flow rearwardly in the flow ports and into the portion of the pipeline at the rear of the pig 10, for being collected at the surface.

In the event the pig should become lodged down hole, the hydraulic release 18 would be activated, as is done in the art, so that the coiled tubing is released from the pig and retrieved. Then a fishing tool would be lowered down hole to engage the pig and retrieve it from its lodged position.

The unique features as described, also include the fact that the pig may be modified at the rig site according to need. For example, the thruster springs may be of different strengths depending on the pressure down hole. Also, the cups may be of various sizes depending on the diameter of the pipeline. All the modifications, it is foreseen, may be done at the rig site so as to facilitate an easy In order to carry out the method as described above of using the pig apparatus 10, reference is made to FIG. 12 which illustrates the pipeline 12, where there is seen a reel 150 of coiled tubing 22 and the coiled tubing 22 inserted within the pipeline 12. The pig 10 is positioned at the end of the coiled tubing 22. As illustrated there is included a pump 152 which would pump the fluid through line 153 into the head 154 of the pipeline after the pig 10 is in place within the pipeline. The fluid would then be pumped via the pump 152 under a predetermined pressure which would move the pig downward in the pipeline in the direction of arrow 160. The fluid is returned in the manner as the pig moves downward as seen in FIG. 8; i.e., the fluid would be returned through the bore 35 in the coiled tubing 22 through line 155 and into a storage tank 157. Likewise any excess fluid would also be returned via line 159 into tank 157 where then it would be repumped via pump 152 in order to move the pig forward. There is also seen a power-pack 170 which is monitored by a console 172 where a worker would monitor all of the functions of the system.

PARTS LIST

The following is a list of suitable parts and materials for the various elements of the preferred embodiment of the present invention.

| | |
|---|---|
| thruster pig apparatus | 10 |
| pipeline | 12 |
| inner surface | 13 |
| bore | 14 |
| point | 15 |
| arrow | 16 |
| hydraulic release mechanism | 18 |
| wall portion | 19 |
| knuckle joint | 20 |
| coiled tubing | 22 |
| threaded member | 23 |
| cups | 24 |
| body | 25 |
| inner metal ring | 26 |
| flared portion | 27 |
| compressible safety ring | 28 |
| nose member | 29 |
| threaded portion | 31 |
| body portion | 32 |
| arms | 33 |
| central flow bore | 34 |
| bore | 35 |
| front end | 36 |
| end portion | 37 |
| rear end | 38 |
| spaces | 39 |
| outer flow bores | 40 |

-continued

| | |
|---|---|
| forward thruster spring | 42 |
| reverse thruster spring | 44 |
| nut | 46 |
| nozzle member | 48 |
| nozzle member | 49 |
| moveable piston member | 50 |
| bores | 51 |
| sealing body | 52 |
| stem member | 53 |
| O rings | 54 |
| debris | 70 |
| pieces | 71 |
| arrows | 75 |
| arrows | 77 |
| arrow | 90 |
| arrow | 100 |
| arrow | 102 |
| arrows | 104 |
| arrow | 110 |
| arrow | 112 |
| fishing tool | 120 |
| grabber end | 122 |
| arrow | 130 |
| reel | 150 |
| pump | 152 |
| line | 153 |
| head | 154 |
| line | 155 |
| storage tank | 157 |
| line | 159 |
| arrow | 160 |
| power pack | 170 |
| console | 172 |

The foregoing embodiments are presented by way of example only; the scope of the present invention is to be limited only by the following claims.

What is claimed is:

1. A bi-directional pig apparatus for use in a pipeline, the pig comprising:

a. a body portion having front and rear end portions and a first principal bore therethrough;

b. a plurality of thruster ports extending through the body portion for allowing fluid to flow through the plurality of thruster ports in a first direction under a first fluid pressure and in a second direction under a second fluid pressure;

c. means within each thruster port for reacting to fluid pressure to allow fluid flow through the thruster ports.

2. The apparatus in claim 1, wherein there are provided at least six thruster ports in the apparatus.

3. The apparatus in claim 1, wherein the means within each thruster port reacting to fluid pressure further comprises a first thruster spring and a second reverse thruster spring for controlling the flow through the ports.

4. The apparatus in claim 3, wherein the first thruster spring is compressible at around 450 lbs./in. of pressure.

5. The apparatus in claim 3, wherein the reverse thruster spring is compressible at around 150 lbs./sq. in of pressure.

6. The apparatus in claim 3, wherein compression of the first thruster spring allows first fluid flow through the plurality of thruster ports from the rear of the pig to contact material ahead of the pig as the pig is moved along the pipeline under pressure.

7. The apparatus in claim 3, wherein compression of the reverse thruster spring allows fluid flow through the thruster ports from the front of the pig returning to the rear of the pig under a certain fluid pressure.

8. The apparatus in claim 1, wherein the apparatus is secured to the end of coiled tubing.

9. The apparatus in claim 1, wherein the apparatus is secured to at least one knuckle joint and hydraulic release mechanism.

10. The apparatus in claim 1, wherein further comprising at least three flexible cups equally spaced apart along the outer wall of the pig body to contact an inner wall of the pipeline.

11. The apparatus in claim 1, wherein the plurality of thruster ports impart a pressurized fluid flow through thruster nozzles, three nozzles emitting fluid ahead of the pig, and three nozzles emitting fluid in a direction against the wall of the pipeline adjacent the pig.

12. The apparatus in claim 1, further comprising compressible rings between each of the cups which would compress under excess pressure within the pipeline to reduce the pressure buildup.

13. A bi-directional pig apparatus secured to the end of coiled tubing within a pipeline, the apparatus comprising:

a. a body portion having front and rear end portions and a first principal bore therethrough;

b. a plurality of thruster ports extending through the body portion;

c. means for allowing fluid to flow through the plurality of thruster ports in a first direction under a certain fluid pressure, and in a second direction under a second fluid pressure;

d. a plurality of cups extending outward from the body portion to a distance equal to the inner diameter of the pipeline; and e. a first fluid flow through the plurality of thruster ports from the rear of the pig to contact material ahead of the pig as the pig is moved along the pipeline under pressure;

f. second fluid flow from the front of the pig returning to the rear of the pig through the first principal bore, the fluid carrying debris contacted by the first fluid flow.

14. The apparatus in claim 13, wherein the apparatus is secured to a pair of knuckle joints for allowing the pig to maneuver through turns in the pipeline.

15. The apparatus in claim 13, wherein the apparatus is secured to hydraulic release mechanism to allow release of the apparatus from the coiled tubing.

16. The apparatus in claim 13, wherein there are provided at least six thruster ports in the apparatus.

17. The apparatus in claim 13, wherein each thruster port further comprises a first thruster spring and a second reverse thruster spring for controlling the flow through the ports.

18. The apparatus in claim 13, wherein the first thruster spring is compressible at around 450 lbs./in. of pressure.

19. The apparatus in claim 13, wherein the reverse thruster spring is compressible at around 150 lbs./sq. in. of pressure.

20. A method of cleaning a pipeline, comprising the following steps:

a. providing a pig apparatus secured to the end of a length of coiled tubing in the pipeline;

b. injecting fluid under pressure into the pipeline behind the pig to impart forward movement of the pig in the pipeline;

c. increasing the fluid pressure behind the pig at a predetermined point so as to open thruster ports within the pig body and allow multiple streams of fluid to flow through the ports and be emitted through a front end of the pig;

d. circulating the emitted fluid back through the pig body, up the coiled tubing to the surface, so that the recirculated fluid carries any pieces of debris dislodged from the pipeline by the emitted fluid flow.

21. The method in claim 20, further comprising the step of retrieving the pig from down the pipeline by flowing fluid under pressure down the bore of the coiled tubing and, under a predetermined pressure, to open the thruster ports in the opposite direction so that the fluid flowing through the coiled tubing bore is returned to the point behind the pig through the thruster ports.

22. The method in claim 20, wherein the thruster ports are opened by fluid pressure acting on a thruster spring at a force of around 450 lbs./sq. in.

23. The method in claim 20, wherein the thruster ports are opened in the opposite direction by fluid force acting a second reverse thruster springs at a force of around 150 lbs./sq. in.

* * * * *